US008209053B2

(12) United States Patent
Kim et al.

(10) Patent No.: US 8,209,053 B2
(45) Date of Patent: Jun. 26, 2012

(54) CLEANING ROBOT

(75) Inventors: Kyoung-woung Kim, Gwangju (KR); Sam-jong Jeung, Gwangju (KR); Jeong-gon Song, Gwangju (KR); Myeong-ho Kim, Gwangju (KR); Tae-young Ryu, Gwangju (KR); Ju-sang Lee, Gwangju (KR); Heung-yi Kim, Gwangju (KR); Sam-hyun Choi, Gwangju (KR); Jang-youn Ko, Gwangju (KR); Dae-hyung Kim, Gwangju (KR); Hak-bong Lee, Gwangju (KR); Yoon-kyunh Cho, Jeoliabuk-do (KR)

(73) Assignee: Samsung Electronics Co., Ltd. (KR)

( * ) Notice: Subject to any disclaimer, the term of this patent is extended or adjusted under 35 U.S.C. 154(b) by 898 days.

(21) Appl. No.: 11/999,852

(22) Filed: Dec. 7, 2007

(65) Prior Publication Data

US 2008/0300720 A1 Dec. 4, 2008

(30) Foreign Application Priority Data

May 31, 2007 (KR) ..... 10-2007-0053270

(51) Int. Cl.
*G06F 19/00* (2011.01)

(52) U.S. Cl. ..... 700/245; 700/247; 700/248; 700/253; 700/258; 318/568.11; 318/568.12; 318/568.17; 701/1; 701/23; 15/319; 180/167; 180/279

(58) Field of Classification Search ..... 700/245, 700/247, 248, 253, 258; 318/568.11, 568.12, 318/568.17; 701/1, 23, 301; 15/319, 340.1; 180/167, 279
See application file for complete search history.

(56) References Cited

U.S. PATENT DOCUMENTS

| | | | | |
|---|---|---|---|---|
| 4,460,826 | A * | 7/1984 | Pryor | 250/227.2 |
| 5,775,750 | A * | 7/1998 | Gauci et al. | 293/2 |
| 6,594,844 | B2 | 7/2003 | Jones | |
| 6,690,134 | B1 | 2/2004 | Jones et al. | |
| 6,748,297 | B2 * | 6/2004 | Song et al. | 700/259 |
| 6,781,338 | B2 | 8/2004 | Jones et al. | |
| 6,809,490 | B2 | 10/2004 | Jones et al. | |

(Continued)

FOREIGN PATENT DOCUMENTS

KR 1020040013892 2/2004

(Continued)

OTHER PUBLICATIONS

Office Action dated Jun. 30, 2011 corresponding to Chinese Patent Application No. 200810085436.X.

*Primary Examiner* — James Trammell
*Assistant Examiner* — McDieunel Marc
(74) *Attorney, Agent, or Firm* — Ohlandt, Greeley, Ruggiero & Perle, LLP

(57) ABSTRACT

An improved cleaning robot that uses a simple structure to sense an obstacle is provided. The cleaning robot includes a robot main body comprising a driving unit to drive the cleaning robot, and a cleaning unit to remove dust, a bumper unit which is movably mounted in the robot main body to protect the robot main body from collision with an obstacle, a sensor unit which supports the bumper unit movably in a plurality of directions to sense the collision of the bumper unit and the obstacle, and a control unit which controls the driving unit on the basis of a signal sensed by the sensor to avoid the obstacle.

15 Claims, 5 Drawing Sheets

U.S. PATENT DOCUMENTS

| | | | | |
|---|---|---|---|---|
| 6,883,201 | B2 | 4/2005 | Jones et al. | |
| 7,388,343 | B2 * | 6/2008 | Jones et al. | 318/587 |
| 7,441,298 | B2 * | 10/2008 | Svendsen et al. | 15/49.1 |
| 7,456,596 | B2 * | 11/2008 | Goodall et al. | 318/568.12 |
| 2004/0204792 | A1 * | 10/2004 | Taylor et al. | 700/245 |
| 2004/0211444 | A1 * | 10/2004 | Taylor et al. | 134/18 |
| 2004/0236468 | A1 * | 11/2004 | Taylor et al. | 700/245 |
| 2004/0244138 | A1 * | 12/2004 | Taylor et al. | 15/319 |
| 2005/0000543 | A1 * | 1/2005 | Taylor et al. | 134/18 |
| 2005/0010331 | A1 * | 1/2005 | Taylor et al. | 700/245 |
| 2005/0217061 | A1 * | 10/2005 | Reindle | 15/319 |
| 2005/0273967 | A1 * | 12/2005 | Taylor et al. | 15/319 |
| 2006/0020369 | A1 * | 1/2006 | Taylor et al. | 700/245 |
| 2008/0134458 | A1 * | 6/2008 | Ziegler et al. | 15/320 |
| 2008/0140255 | A1 * | 6/2008 | Ziegler et al. | 700/245 |
| 2008/0155768 | A1 * | 7/2008 | Ziegler et al. | 15/4 |
| 2008/0184518 | A1 * | 8/2008 | Taylor et al. | 15/319 |

FOREIGN PATENT DOCUMENTS

| | | |
|---|---|---|
| KR | 1020040096252 | 11/2004 |
| WO | WO02067745 | 9/2002 |

* cited by examiner

CLEANING ROBOT

CROSS-REFERENCE TO RELATED APPLICATIONS

This application claims priority under 35 U.S.C. §119 from Korean Patent Application No. 10-2007-0053270, filed on May 31, 2007, in the Korean Intellectual Property Office, the disclosure of which is incorporated herein by reference in its entirety.

BACKGROUND OF THE INVENTION

1. Field of the Invention

Apparatus consistent with the present disclosure relate to cleaning robots.

2. Description of the Related Art

A cleaning robot automatically runs and cleans an area without user manipulation.

The cleaning robot comprises a main body, a cleaning unit which is provided in the robot main body and draws in dust, a driving unit which drives the robot main body, a bumper unit which protects the robot main body, and a control unit which controls driving of the robot main body. The cleaning unit comprises a suction brush, a dust collecting receptacle having a filter, and a suction motor as a general vacuum cleaner.

The bumper unit forms an external surface of the robot main body, and a plurality of obstacle sensors which sense collision of the bumper unit with obstacles are provided in the interior of the bumper unit. The plurality of obstacle sensors are provided as point of contact sensors, which operate individually to sense collisions with obstacles from a plurality of directions. As a result, the robot's structure becomes overly complicated and fabrication of the robot becomes more costly.

The bumper unit is mounted to protrude from the robot main body to protect the robot main body. The protrusion causes the cleaning robot to look bad, and causes the bumper unit to be damaged when the cleaning robot collides with an obstacle.

SUMMARY OF THE INVENTION

Exemplary embodiments of the present disclosure address at least the above problems and/or disadvantages and other disadvantages not described above. Also, the present disclosure is not required to overcome the disadvantages described above, and an exemplary embodiment of the present disclosure may not overcome any of the problems described above.

The present disclosure provides an improved cleaning robot that uses a simple structure to sense an obstacle.

One exemplary embodiment of a cleaning robot of the present disclosure comprises a robot main body having a driving unit to drive the cleaning robot, and a cleaning unit to remove dust, a bumper unit which is movably mounted in the robot main body to protect the robot main body from collision with an obstacle, a sensor unit which supports the bumper unit movably in a plurality of directions to sense the collision of the bumper unit and the obstacle, and a control unit which controls the driving unit on the basis of a signal sensed by the sensor unit to avoid the obstacle.

The sensor unit may comprise a supporting member that supports the bumper unit movably in a plurality of directions, and a sensor that senses movement of the supporting member.

The supporting member may support approximately the central part of the bumper member movably in a plurality of directions.

The sensor unit may comprise a joystick type sensor that is operated by the bumper unit.

The bumper unit may comprise a bumper member that is mounted in the robot main body, and a protection member that is made of an elastic material surrounding an exterior of the bumper member.

The bumper unit may be mounted in the robot main body to be protruded to the exterior of the robot main body.

The bumper unit may be capable of moving between a cleaning position and a colliding position with the obstacle on the basis of the supporting member.

One end of the supporting member may support the bumper member, and another end of the supporting member may be rotatably inserted into a supporting member holder which is provided in the robot main body.

The cleaning robot may comprise a running sensor that senses running distance of the robot main body and the obstacle on a running path.

The control unit may control driving of the cleaning unit on the basis of the signal sensed by the sensor unit.

According to another exemplary aspect of the present disclosure, there is provided a cleaning robot comprising a robot main body having a driving unit to drive the cleaning robot, and a cleaning unit to remove dust, a bumper unit which is movably mounted in the robot main body to protect the robot main body from collision with an obstacle.

The bumper unit may comprise a bumper member that is mounted in the robot main body, and a protection member that is made of an elastic material surrounding an exterior of the bumper member.

The bumper unit may be mounted in the robot main body to be protruded to the exterior of the robot main body.

The cleaning robot may comprise the supporting member that supports approximately the central part of the bumper unit to move in a plurality of directions with respect to the robot main body.

The bumper unit may be capable of moving between a cleaning position and a colliding position with the obstacle on the basis of the supporting member.

A sensor sensing movement of the bumper unit may be mounted in the supporting member.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION OF THE INVENTION

Figure 1:
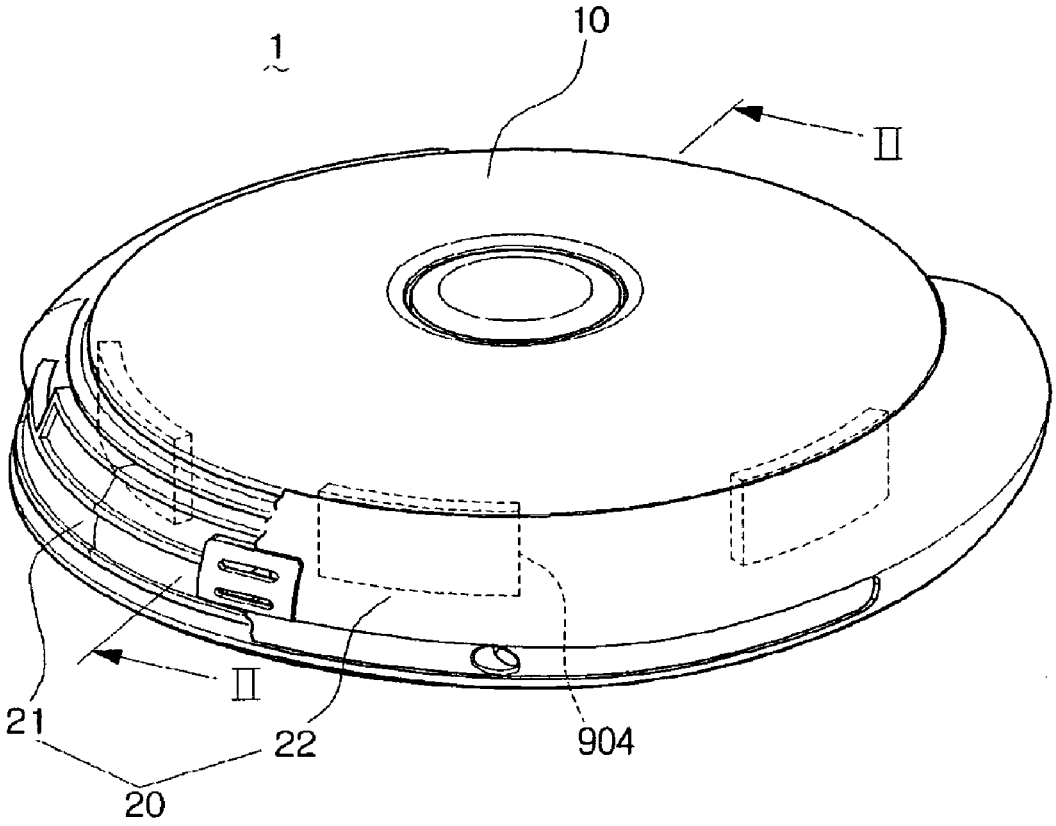
FIG. 1 is a schematic perspective view of a cleaning robot according to an exemplary embodiment of the present disclosure.

Certain exemplary embodiments of the present disclosure will now be described in greater detail with reference to the accompanying drawings.

In the following description, the same drawing reference numerals are used for the same elements even in different drawings. The matter defined in the description, such as detailed construction and elements, are provided to assist in a comprehensive understanding of the disclosure. Thus, it is apparent that the present disclosure can be carried out without such specifically defined matter. Also, well-known functions or constructions are not described in detail since they would obscure the disclosure with unnecessary detail.

Figure 2:
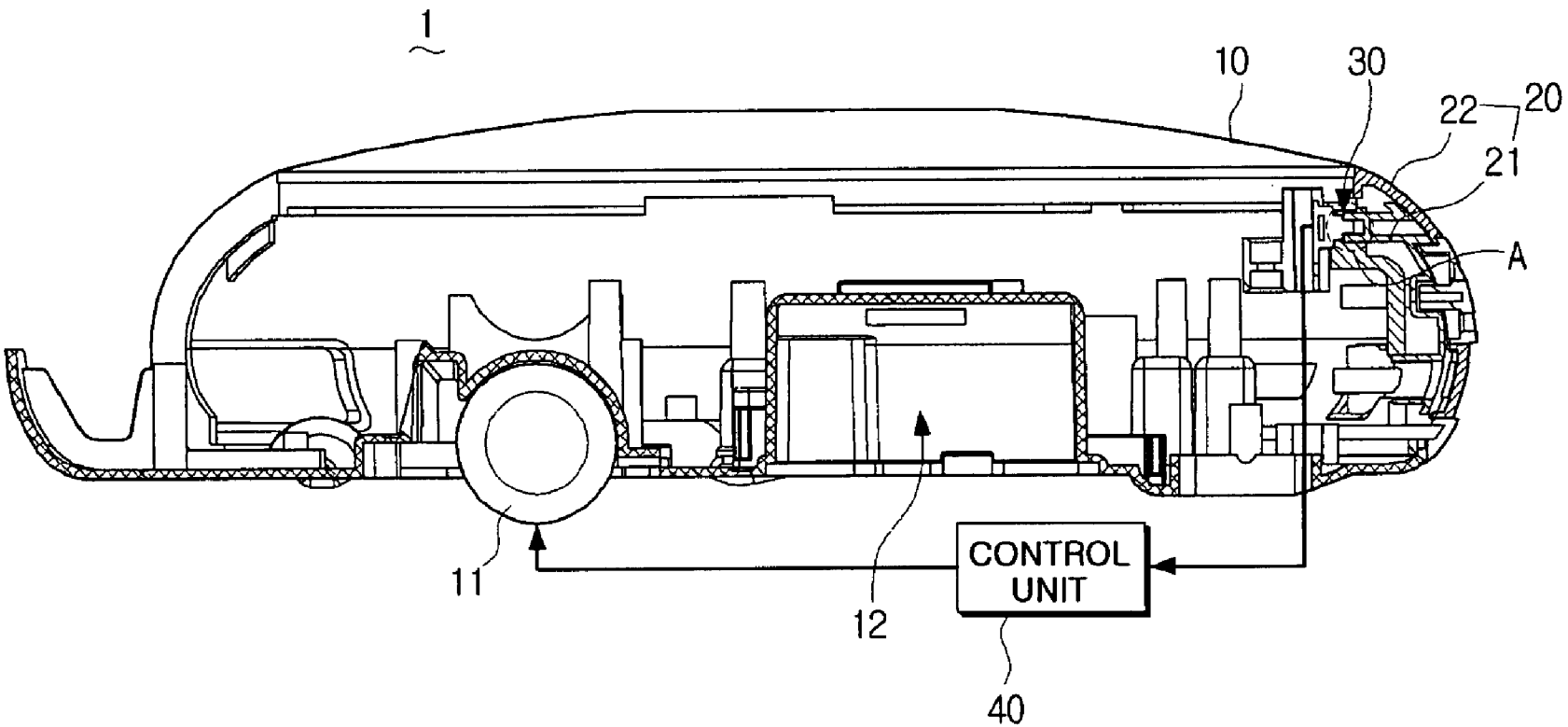
FIG. 2 is a cross-sectional view taken along line II-II of FIG. 1.

Referring to FIGS. 1 and 2, a cleaning robot according to an exemplary embodiment of the present disclosure may comprise a robot main body 10, a bumper unit 20, a sensor unit 30, and a control unit 40.

The robot main body 10 comprises a driving unit 11 to drive the cleaning robot, and a cleaning unit 12 to remove dust.

The driving unit 11 comprises a driving motor (not shown), and a driving wheel driven by driving force.

The cleaning unit 12 comprises a brush member (not shown) which is rotated by suction force generated from a suction motor (not shown) and which is mounted in a suction port to clean dust from a surface being cleaned. Dust drawn in through the suction port is collected by a dust collecting means (not shown) after being separated by a dust separating filter.

The above structure of the cleaning unit 12 is similar to that of a general cleaning robot, and thus detailed descriptions and drawings are omitted for the sake brevity.

A running sensor 904 is disposed around the side of the robot main body 10. Running sensor 904 is capable of emitting a signal to the exterior; capable of receiving a reflected signal; capable of detecting the running distance of cleaning robot 1; and capable of sensing an obstacle in the way of cleaning robot 1. A battery (not shown) may be mounted to run in the robot main body 10.

The bumper unit 20 is mounted in the robot main body 10 to protect the robot main body 10 from a collision with an unexpected obstacle. That is, the bumper unit 20 buffers a shock caused by the collision with an unexpected obstacle such that damage to robot main body 10 is prevented.

The bumper unit 20 is designed to cover a front surface and a partial side surface of robot main body 10, relative to a running direction of the robot main body 10. That is, if the robot main body 10 is substantially circularly plate-shaped, as shown in FIG. 1, the bumper unit 20 has a substantially semicircular ring shape.

The bumper unit 20 comprises a bumper member 21 which is supported by the robot main body 10, and a protection member 22 which protects the bumper member 21.

The bumper member 21 is movably supported in proper position of the robot main body 10 to be capable of moving when the bumper member 21 collides with an obstacle P as shown in FIGS. 4A to 5B. The protection member 22 is formed to cover the bumper member 21.

The protection member 22 is formed not to protrude from a rear surface and a rear side surface of the robot main body 10 where the bumper unit 20 is not disposed, considering an appearance of the robot main body 10. That is, the bumper unit 20 is inserted in the robot main body 10 to a predetermined depth to form a smooth exterior surface of a cleaning robot.

The bumper member 21 is made of a material which is robust to impact. One such material is a plastic robust to impact. The protection member 22 may be made of an elastic material which is capable of being transformed by external force (such as an impact), to protect the bumper member 21 disposed therein. One such elastic material is rubber. However, materials of the bumper member 21 and the protection member 22 should not be limited to the above examples.

The bumper unit 20, being constructed as above, can mitigate a shock caused by the sudden collision of cleaning robot 1 with the obstacle P. Accordingly, the robot main body 10 may be protected safely. The protection member 22 of an elastic material (e.g. rubber) is provided such that the protection member 22 prevents the bumper member 21 from being damaged by the shock.

The sensor unit 30 senses whether the bumper unit 20 collides with an obstacle by detecting movement of the bumper unit 20. The sensor unit 30 senses whether the bumper unit 20 collides with an obstacle P which is not detected by a running sensor 904 while the cleaning robot 1 runs. The sensor unit 30 comprises a supporting member 31 and a sensor 32 as shown in FIGS. 2 and 3.

The supporting member 31 supports the bumper member 21 to move in a plurality of directions. That is, the supporting member 31 movably supports an approximately central part of the bumper member 21. The bumper member 21 moves on the basis of the supporting member 31.

Figure 3:
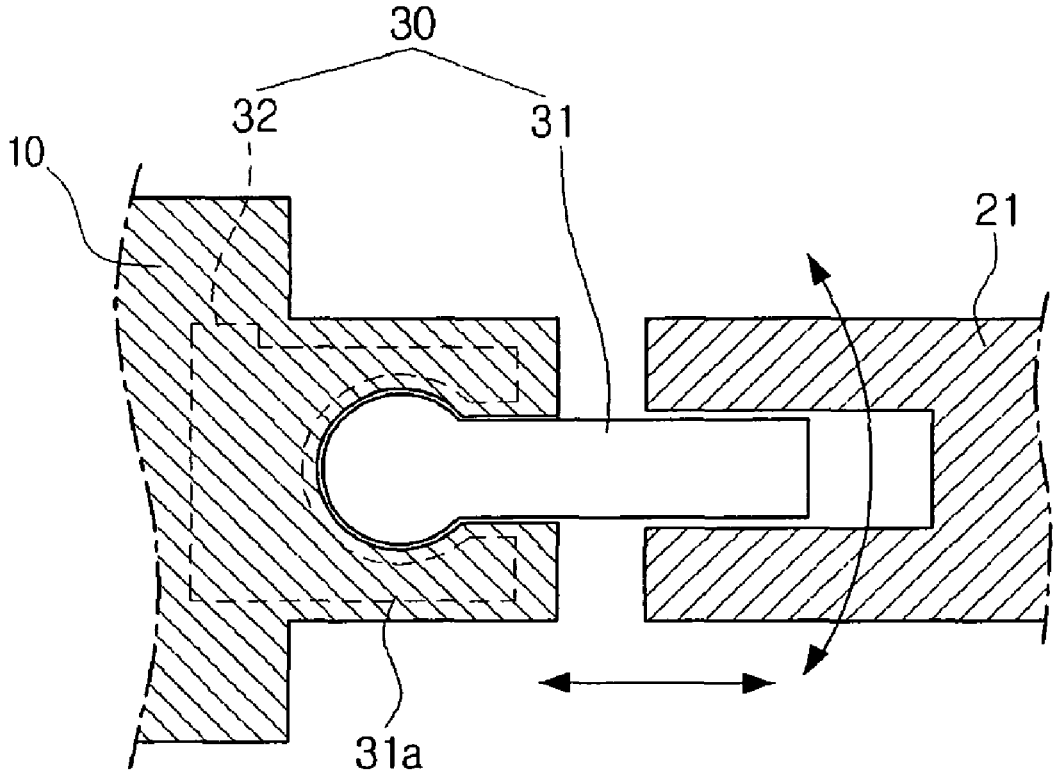
FIG. 3 is a cross-sectional view of the area A of FIG. 2.

Referring to FIG. 3, the robot main body 10 is movably mounted at a first end of the supporting member 31, and a second end of the supporting member 31 is inserted into a supporting member holder 31 a which is provided in the robot main body 10. The second end of the supporting member 31 has a ball shape such that the supporting member 31 may rotate multidirectionally on the basis of the second end of supporting member 31 inserted in the supporting member holder 31*a*.

The bumper member 21 is capable of moving between a cleaning position (assumed when cleaning robot 1 is cleaning a surface)and a colliding position (assumed when cleaning robot 1 has collided with an obstacle) where the bumper member 21 escapes from the cleaning position by collision with the obstacle.

The sensor 32 senses movement of the supporting member 31. The supporting member 31 and the sensor 32 are provided as a joystick type sensor which is operated by the movement of the bumper member 21.

The control unit 40 controls the driving unit 11 on the basis of the signal sensed by the sensor unit 30. That is, if the sensor unit 30 senses the bumper unit 20 at the cleaning position, the control unit 40 controls the driving unit 11 on the basis of the sensed signal such that the robot main body 10 cleans along a predetermined path of a surface being cleaned.

If the sensor unit 30 senses that the bumper member 21 moves to the colliding position by collision of the bumper member 21 and an obstacle, the control unit 40 controls the driving unit 11 on the basis of the sensed signal to cause the robot main body 10 to avoid colliding with the obstacle.

If it is determined that the robot main body 10 avoids the obstacle by the control unit 40, the robot main body 10 cleans by running along the predetermined path.FIG. 1 is a schematic perspective view of a cleaning robot 1. Cleaning robot 1 provides a robot main body 10, and a bumper unit 20.

Referring to FIGS. 1 to 3, the robot main body 10 cleans dust from a surface being cleaned by running along a predetermined path at the cleaning position where the robot main body 10 does not collide with an obstacle.

Referring to FIGS. 4A to 5B, if the robot main body 10 collides with an unexpected obstacle B which is not sensed by the running sensor 904 while the robot main body 10 runs, the bumper member 21 moves from the cleaning position to the colliding position on the basis of the supporting member 31.

Figure 4A:
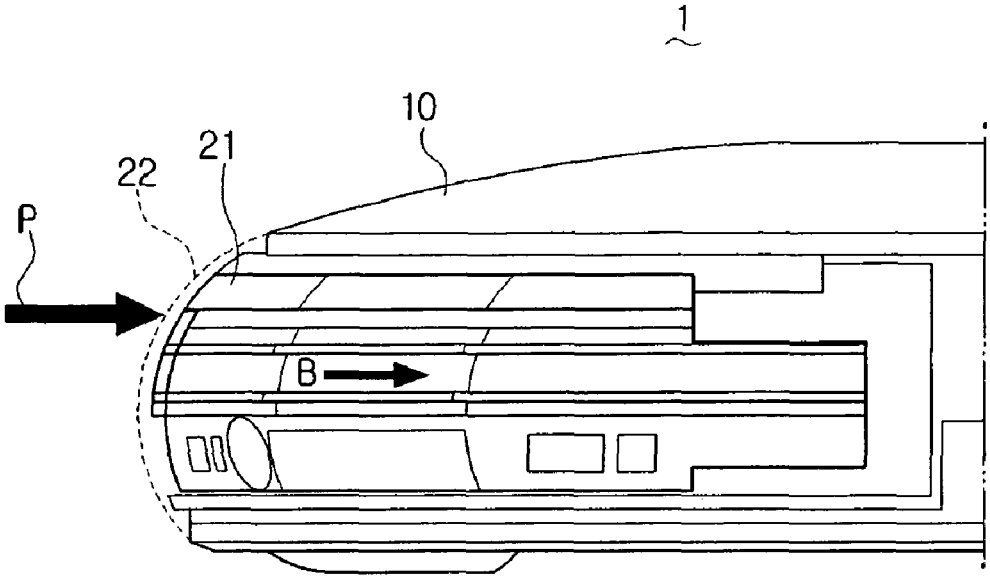
FIGS. 4A to 5B are schematic views illustrating movement of a bumper unit.

Specifically, if the obstacle P collides with a front surface-upper portion of the robot main body 10, the bumper member 21 moves from the cleaning position, and changes to the colliding position in direction B along the supporting member 31 as shown in FIG. 4A.

Figure 4B:
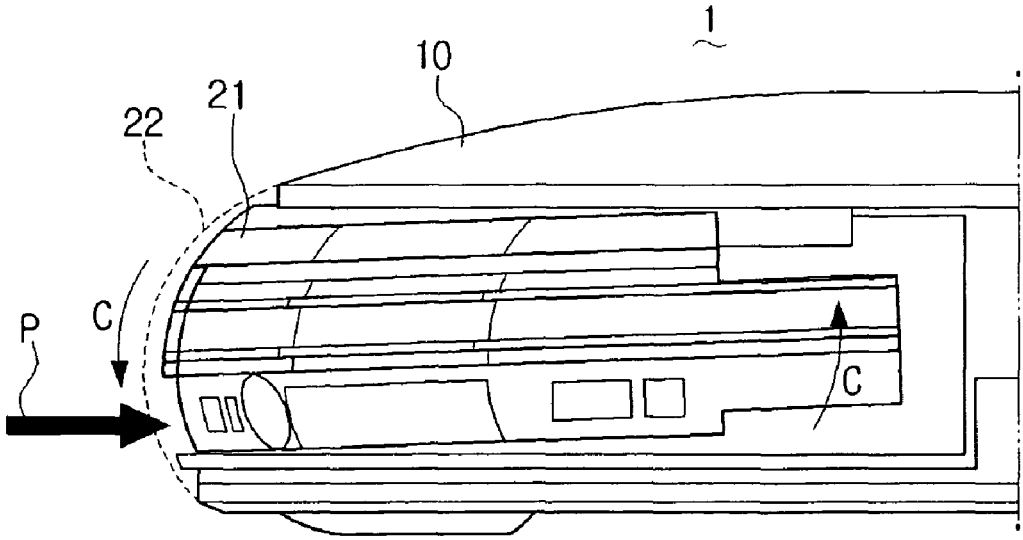

If the obstacle P collides with the robot main body 10 at a portion lower than the position where the sensor unit 30 is disposed as shown in FIG. 4B, the bumper member 21 rotates in direction C on the basis of the supporting member 31 on the cleaning member, and moves to the colliding position. Accordingly, opposite ends of the bumper member 21 are lifted to the upper portion.

Figure 5A:
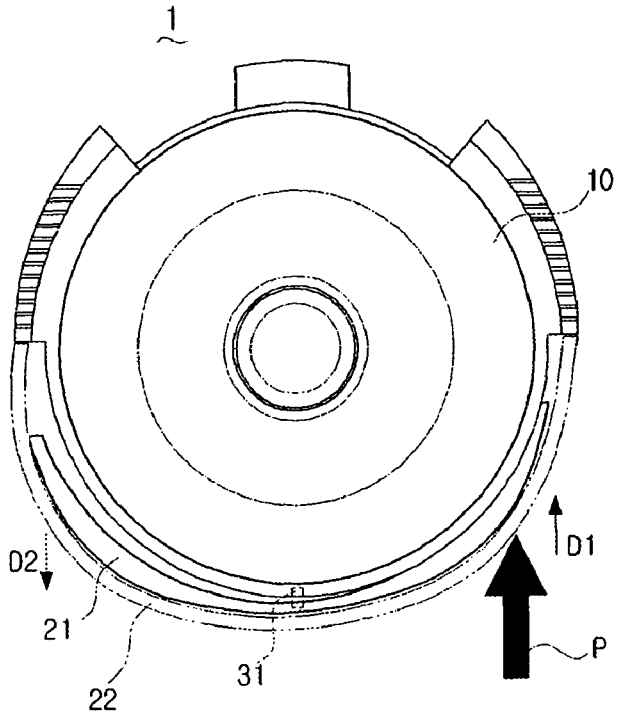

If the obstacle P collides with a right side of the bumper member 21 on the basis of the sensor unit 30 as shown FIG. 5A, the bumper member 21 moves from the cleaning position, and the right side rotates in direction D1, and a left side rotates in direction D2 on the basis of the supporting member 31.

Figure 5B:
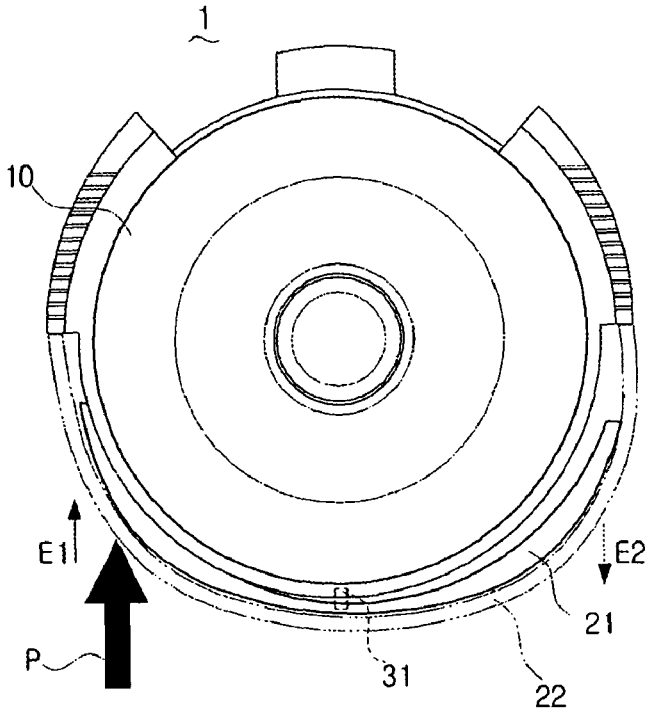

If the obstacle P collides with a left side of the bumper member 21 on the basis of the sensor unit 30 as shown FIG. 5B, a left side of the bumper member 21 rotates in direction E1, and a right side of the bumper member 21 rotates in direction E2 on the basis of the supporting member 31.

If the obstacle P collides with the bumper member 21 on various position as above, the bumper member 21 moves on the basis of the supporting member 31 such that the supporting member 31 moves in association with the bumper member 21. Accordingly, the sensor 32 senses the movement of the supporting member 31 such that it may be sensed whether the obstacle P collides against the bumper member 21, and where the collision occurs.

The sensing information of the sensor 32 is provided to the control unit 40, and the control unit 40 controls the driving unit 11 using the sensing information. If the collision information of the bumper member 32 and the obstacle P is transferred to the control unit 40, the control unit 40 controls a driving direction of the driving unit 11 to move robot main body 10 and its affiliated structures from the colliding position with the obstacle P.

If the collision information of the obstacle P is transferred to the control unit 40, then the control unit 40 controls not only the driving unit 11 but also the cleaning unit 12 such that the cleaning operation may be stopped until the robot main body 10 avoids the obstacle P.

If the robot main body 10 avoids the obstacle P by the control unit 40 and the bumper member 21 is at the cleaning position, the control unit 40 directs a re-performance of cleaning while the robot main body 10 runs along a predetermined path.

As described above, the sensor unit 30 of a joystick type senses movement of the bumper member 21 moving when the obstacle and the bumper unit 20 collide against each other according to an exemplary embodiment of the present disclosure. Accordingly, the robot main body 10 having simple structure may sense and control collision against the obstacle P without the need for complex control structures. As a result, fabricating a cleaning robot 1 is less costly.

Because bumper unit 21 is constructed to have a smooth finish, the appearance of the cleaning robot 1 is improved. Additionally, a protection member of an elastic material to protect a bumper member 22 by the bumper unit 21 is provided such that damage by collision with obstacles may be prevented.

The foregoing embodiments and advantages are merely exemplary and are not to be construed as limiting the present disclosure. The present teaching can be readily applied to other types of apparatus. Also, the description of the exemplary embodiments of the present disclosure is intended to be illustrative, and not to limit the scope of the claims, and many alternatives, modifications, and variations will be apparent to those skilled in the art.

What is claimed is:

1. A cleaning robot comprising:

a robot main body comprising a driving unit to drive the cleaning robot, and a cleaning unit to remove dust;

a bumper unit which is movably mounted in the robot main body to protect the robot main body from a collision with an obstacle;

a sensor unit which supports the bumper unit movably in a plurality of directions including a linear direction and a rotary direction to sense the collision of the bumper unit and the obstacle wherein the sensor unit comprises a supporting member and a sensor which senses movement of the supporting member, wherein the supporting member has a first end that supports the bumper member and a second end that is rotatably inserted into a supporting member holder, the supporting member holder being provided in the robot main body; and a control unit which controls the driving unit on the basis of a signal sensed by the sensor unit to avoid the obstacle.

2. The cleaning robot of claim 1, wherein the supporting member supports approximately a central part of the bumper unit movably in the plurality of directions.

3. The cleaning robot of claim 1, wherein the sensor unit comprises a joystick type sensor which is operated by the bumper unit.

4. The cleaning robot of claim 3, wherein the bumper unit comprises:

a bumper member which is mounted in the robot main body; and a protection member which is made of an elastic material and which surrounds an exterior of the bumper member.

5. The cleaning robot of claim 4, wherein the bumper unit is mounted in the robot main body and protrudes therefrom.

6. The cleaning robot of claim 4, wherein the bumper unit moves about the supporting member between a first position and a second position, upon the collision of the bumper unit with the obstacle.

7. The cleaning robot of claim 1, further comprising a running sensor which senses running distance of the robot main body and the obstacle on a running path of the cleaning robot.

8. The cleaning robot of claim 1, wherein the control unit controls the cleaning unit on the basis of the signal sensed by the sensor unit.

9. A cleaning robot comprising:

a robot main body comprising a driving unit driving the cleaning robot, and a cleaning unit removing dust;

a bumper unit which is mounted in the robot main body for movement in a plurality of directions including a linear direction and a rotary direction and protects the robot main body from a collision with an obstacle; and a sensor unit, wherein the sensor unit comprises a supporting member and a sensor which senses movement of the supporting member, wherein the supporting member has a first end that supports the bumper member and a second end that is rotatably inserted into a supporting member holder, the supporting member holder being provided in the robot main body.

10. The cleaning robot of claim 9, wherein the bumper unit comprises:

a bumper member which is mounted in the robot main body; and a protection member which is made of an elastic material and which surrounds an exterior of the bumper member.

11. The cleaning robot of claim 10, wherein the bumper unit is mounted in the robot main body, and wherein the bumper unit protrudes from an exterior surface of the robot main body.

12. The cleaning robot of claim 10, wherein the supporting member supports approximately a central part of the bumper unit to move in a plurality of directions with respect to the robot main body.

13. The cleaning robot of claim 12, wherein the bumper unit moves between a cleaning position and a colliding position with the obstacle on the basis of the supporting member.

14. The cleaning robot of claim 12, wherein the sensor sensing movement is mounted in the supporting member.

15. A cleaning robot comprising:

a robot main body having a driving unit to drive the cleaning robot and a cleaning unit to remove dust from a surface;

a bumper unit to protect the robot main body from a collision with an obstacle;

a sensor in the robot main body that supports the bumper unit so that the bumper unit protrudes from an exterior surface of the robot main body and moves in both a linear direction and a rotary direction, the sensor senses the collision of the bumper unit with the obstacle, wherein the sensor unit comprises a supporting member and a sensor which senses movement of the supporting member, wherein the supporting member has a first end that supports the bumper member and a second end that is rotatably inserted into a supporting member holder, the supporting member holder being provided in the robot main body; and a control unit which controls both the driving unit and the cleaning unit on the basis of a signal sensed by the sensor unit.

* * * * *